US006311704B1

(12) United States Patent
Foster

(10) Patent No.: US 6,311,704 B1
(45) Date of Patent: Nov. 6, 2001

(54) METHODS AND APPARATUS FOR CHEMICALLY CLEANING TURBINES

(75) Inventor: Charles D. Foster, Keyser, WV (US)

(73) Assignee: HydroChem Industrial Services, Deer Park, TX (US)

( * ) Notice: Subject to any disclaimer, the term of this patent is extended or adjusted under 35 U.S.C. 154(b) by 0 days.

(21) Appl. No.: 09/519,065

(22) Filed: Mar. 3, 2000

(51) Int. Cl.[7] ..... B08B 9/093
(52) U.S. Cl. ..... 134/22.18; 134/166 R
(58) Field of Search ..... 134/22.18, 166 R, 134/169 R; 415/117, 118

(56) References Cited

U.S. PATENT DOCUMENTS

| | | | | |
|---|---|---|---|---|
| 5,018,355 | | 5/1991 | Foster . | |
| 5,090,205 | | 2/1992 | Foster . | |
| 5,679,174 | * | 10/1997 | Buongiorno | 134/22.18 |
| 5,938,402 | * | 8/1999 | Bochud et al. | 134/169 X |

* cited by examiner

*Primary Examiner*—Philip R. Coe
(74) *Attorney, Agent, or Firm*—Shook, Hardy & Bacon, L.L.P.

(57) ABSTRACT

The present invention is directed to an apparatus for injecting cleaning materials into the steam chest of a turbine and to methods for cleaning high pressure turbine using that apparatus. The apparatus enables chemical foam to be input to the turbine through an existing port by temporarily replacing a valve attached to the steam chest. The apparatus, once attached to the steam chest, is free of moving parts, yet permits injection of chemical foam through any one or more of the steam chest apertures. The apparatus includes a housing, together with a plurality of inlets, one of which is in fluid communication with a telescoping injector for sealing engagement with a steam chest aperture. In the methods of the present invention, chemical foam may be directed through any one or more of the steam chest apertures into the turbine blade sections by operation of the remaining governor/control valves. When the cleaning process has been completed, the injection apparatus may be quickly replaced with the original valve.

29 Claims, 5 Drawing Sheets

METHODS AND APPARATUS FOR CHEMICALLY CLEANING TURBINES

BACKGROUND OF THE INVENTION

I. Field of the Invention

The present invention generally relates to methods and apparatus for permitting periodic introduction of cleaning agents, e.g., chemical foams, into a steam turbine to remove deposits without altering the turbine system or mechanisms. More specifically, the present invention is directed to apparatus that can be attached to the steam chest of a turbine and through which foamed cleaning agents can be directly injected into the steam chest and directed to all portions of the turbine for cleaning purposes. More specifically, the present invention relates to apparatus and methods which achieve the foregoing goal while being free of moving parts after installation.

II. Description of the Background

The demand for electricity continues to expand, both within the United States and abroad. A particularly favored means for producing electricity employs steam driven turbines. As electrical demand has grown, both the number of operating turbines and their hours of operation have increased. At the same time, the need to control operating costs and to minimize environmental impact have grown. Accordingly, it is desirable that these turbines operate in the most cost and energy efficient ways possible.

Older turbines are often refurbished with newer components to improve efficiency. Replaced components may include items such as nozzle blocks and reaction blading and may, because of improved manufacturing techniques and use of harder materials, result in closer tolerances. Thus, steam flow is often restricted after refurbishment. Because these harder materials do not erode as rapidly as did the older materials, keeping the flow path clean becomes essential to maintaining efficient turbine operation. In older systems, the enlargement of the flow path cross-section caused by the erosion characteristic of older materials would, in many cases, compensate for the reduction in flow path cross-section resulting from chemicals deposited during operation. These deposits primarily comprise metals. While copper, iron and their oxides comprise the primary deposits, calcium and other chemicals are also deposited. Adequate steam flow cross-section was often maintained in older systems by the tradeoff of erosion with the growth of metallic deposits. With the harder materials characteristic of newer systems, erosion is no longer able to compensate for growth of these metallic deposits. Accordingly, both the use of harder materials and closer tolerances, together with the desire to improve operating efficiency, have all combined to create conditions more sensitive to chemical deposit and to require more frequent and better cleaning.

When metallic deposits do build up inside the turbine, it is important to remove them as quickly as possible. One approach often used has been to blast the deposits off the internal parts using grit or sand. Obviously, however, sandblasting methods require that the high pressure turbine be disassembled. The resulting costs of disassembly, cleaning, reassembly and loss of revenue during the long down times associated with sandblasting can be quite high. For example, in 1999, the typical cost for disassembly, sandblasting and reassembly of a high pressure, 350 megawatt turbine has been estimated to be about four hundred thousand dollars ($400,000.00). More importantly, at an average cost of $30/megawatt/hour for replacement power, the cost for replacing lost power would exceed two hundred fifty thousand dollars ($250,000.00) per day. Thus, sandblasting methods are avoided, if at all possible.

A much more cost effective method for removing metallic deposits has been chemical cleaning of the turbine and its internal parts. In chemical cleaning methods, foamed cleaning materials have been injected into the steam path of the turbine. The best cleaning results have been obtained by injection of foamed chemical cleaning agents with the turbine turning. Chemical cleaning methods have been successfully used by utility companies to remove metallic deposits with minimal disruption so that load losses caused by deposits in the steam paths of power turbines can be minimized.

However, chemical cleaning of a high pressure turbine requires the chemical cleaning agents, most often foamed cleaning materials, to be injected into the main steam system and to follow the steam path during normal operation. Injection ports leading into the main steam loop that feed steam to the governor or control valve system are thus required. Accordingly, it was necessary to penetrate the main steam lines to install these injection ports. The initial cost for installation of an injection port typically exceeds fifty thousand dollars ($50,000.00). Further, these installations required welding and appropriate stress relief measures, followed by testing for quality, integrity and stress, e.g., x-ray testing, prior to use. In the event that the structural integrity of the pressure vessel was effected, further repairs were then required.

After completion of the cleaning operation, the injection port must be capped, requiring additional welding and structural integrity testing before the turbine can be placed back into operation. While future cleaning could employ the same injection port, without again incurring the initial installation costs, time and expense in removing and replacing the cap and in retesting the structural integrity were not insignificant. In 1999, the estimated cost for each successive cleaning of a 350 megawatt turbine was about fifty thousand dollars ($50,000.00), not including load curtailment costs exceeding two hundred fifty thousand dollars ($250,000.00) per day to cover replacement power. Thus, while these chemical cleaning methods are more efficient and cost effective than sandblasting, they still suffer from high costs and potential safety problems.

Many of the problems associated with the cleaning methods described above were solved by the steam injection apparatus described in my prior U.S. Pat. No. 5,018,355. The injection apparatus of the '355 patent was designed to replace an existing governor or control valve on the steam chest of a high pressure turbine. Using my injector, chemical foam for cleaning metallic deposits from the interior surfaces of the turbine could be injected from outside the turbine without requiring independent penetration of the main steam loop of the turbine. When the cleaning process was finished, the original governor or control valve could be easily re-installed in a short period of time. Thus, the initial installation costs, together with the expensive and time consuming testing for structural integrity, could be eliminated because the injection apparatus employed an existing port on the steam chest. However, the reciprocating assembly of my prior injection apparatus was found to be unnecessarily complicated and, thus, suffered from potential operating problems. While my prior injection apparatus was a significant improvement over other systems, the industry has continued to seek improved, less complicated chemical injectors.

Thus, there has been a long felt but unfulfilled need for simpler, less expensive methods and apparatus for cleaning high pressure turbines. The present invention solves those needs by providing an apparatus which is capable of injecting chemical cleaning agents into the steam chest of a high pressure turbine through an existing port and which is free of moving parts after installation.

SUMMARY OF THE INVENTION

The present invention is directed to an apparatus for injecting cleaning materials into the steam chest of a turbine and to methods for cleaning high pressure turbines using that apparatus. The apparatus of the present invention is designed to temporarily replace a valve on the steam chest so that the cleaning materials can be injected into the turbine steam loop through an existing port. Further, the apparatus is designed so that it is free of moving parts once installed. Thus, many of the operating problems encountered with prior art injectors have been eliminated.

The apparatus comprises a housing assembly having walls defining a closed, hollow interior terminating with an outlet at one end. Extending radially outwardly from the outlet is a flange for attaching the assembly to a turbine so that the outlet is aligned with a turbine port in fluid communication with the steam chest of the turbine. Disposed in a wall of the housing is a first inlet for defining an open passageway for delivering cleaning materials, preferably foamed cleaning agents, into the hollow, interior and through the outlet into the steam chest. Finally, the apparatus includes a second inlet in fluid communication with an injector disposed within the hollow interior and passing through the outlet wherein the injector is adapted for sealing engagement with a steam chest aperture adjacent the outlet for separately delivering cleaning materials to the turbine.

The apparatus is configured and sized so that it can be attached to the turbine in place of a conventional governor or control valve on the steam chest. Alternatively, the apparatus may be attached, with an adaptor plate if required, in place of a conventional throttle or stop valve on the steam chest.

In the presently preferred embodiment, the injector comprises first and second telescoping members. The first telescoping member is fixed within the hollow interior in fluid communication with the second inlet, while the second telescoping member is movable in relation to the first member and adapted at one end for sealing engagement with a steam chest aperture adjacent the housing outlet. The second tubular member is biased into sealing engagement with the aperture by a compression spring or other conventional biasing means. For convenience, the compression spring may be detachably fixed at one end to the interior of the housing and at the other end to the movable telescoping member.

In a more preferred embodiment, the second telescoping member comprises first and second sections detachably fixed together. In the presently most preferred embodiment, the sections are detachably threaded together and, further, may include an extender detachably disposed between the first and second sections.

In an alternative embodiment, the injector comprises a first member fixed within the hollow interior of the injection apparatus and in fluid communication with the second inlet with a second member detachably fixed thereto and adapted for sealing engagement with the steam chest aperture. The length and diameter of the second member is selected to sealingly engage the steam chest aperture. In further refinement, the second, detachably fixed member is a flexible tubular member. In another alternative embodiment, the injector comprises a flexible tubular member fixed within the hollow interior of the injection apparatus in fluid communication with the second inlet and adapted for sealing engagement with the steam chest aperture.

The previously described injection apparatus is employed in the methods of the present invention to deliver foamed cleaning materials to a turning turbine through an existing port in the steam chest thereof. The preferred method comprises temporarily replacing one of the existing governor or control valves on the steam chest with an injection apparatus in accord with the present invention and pumping foamed cleaning materials through the apparatus into the steam chest and through one or more steam chest apertures into the turning turbine. Injection through one or more of the steam chest apertures is controlled by adjusting the remaining governor or control valves when injecting through the first inlet. Foam can also be injected through the second inlet directly into the turbine through the adjacent steam chest aperture. The method of the present invention further includes returning the spent, foamed chemicals to a liquid, removing the liquid foam from the turbine and replacing the injection apparatus with the removed valve. In an alternative method, the injection apparatus of the present invention temporarily replaces a throttle or stop valve, using an adapter if necessary. In this alternative method, the foamed materials are injected into the steam chest and through one or more steam chest apertures controlled by the governor or control valves into the turbine.

Thus, the long felt, but unfulfilled need for a simplified apparatus for injecting cleaning chemicals into a turbine and for methods of cleaning turbines using that apparatus has been met. These and other meritorious features and advantages of the present invention will be more fully appreciated from the following description and claims.

BRIEF DESCRIPTION OF THE DRAWINGS

Other features and intended advantages of the present invention will be more readily apparent by reference to the following detailed description in connection with the accompanying drawings wherein.

While the invention will be described in connection with the presently preferred embodiment, it will be understood that this is not intended to limit the invention to that embodiment. To the contrary, it is intended to cover all alternatives, modifications and equivalents as may be included in the spirit of the invention as defined in the appended claims.

DETAILED DESCRIPTION OF THE PREFERRED EMBODIMENT

Figure 1:
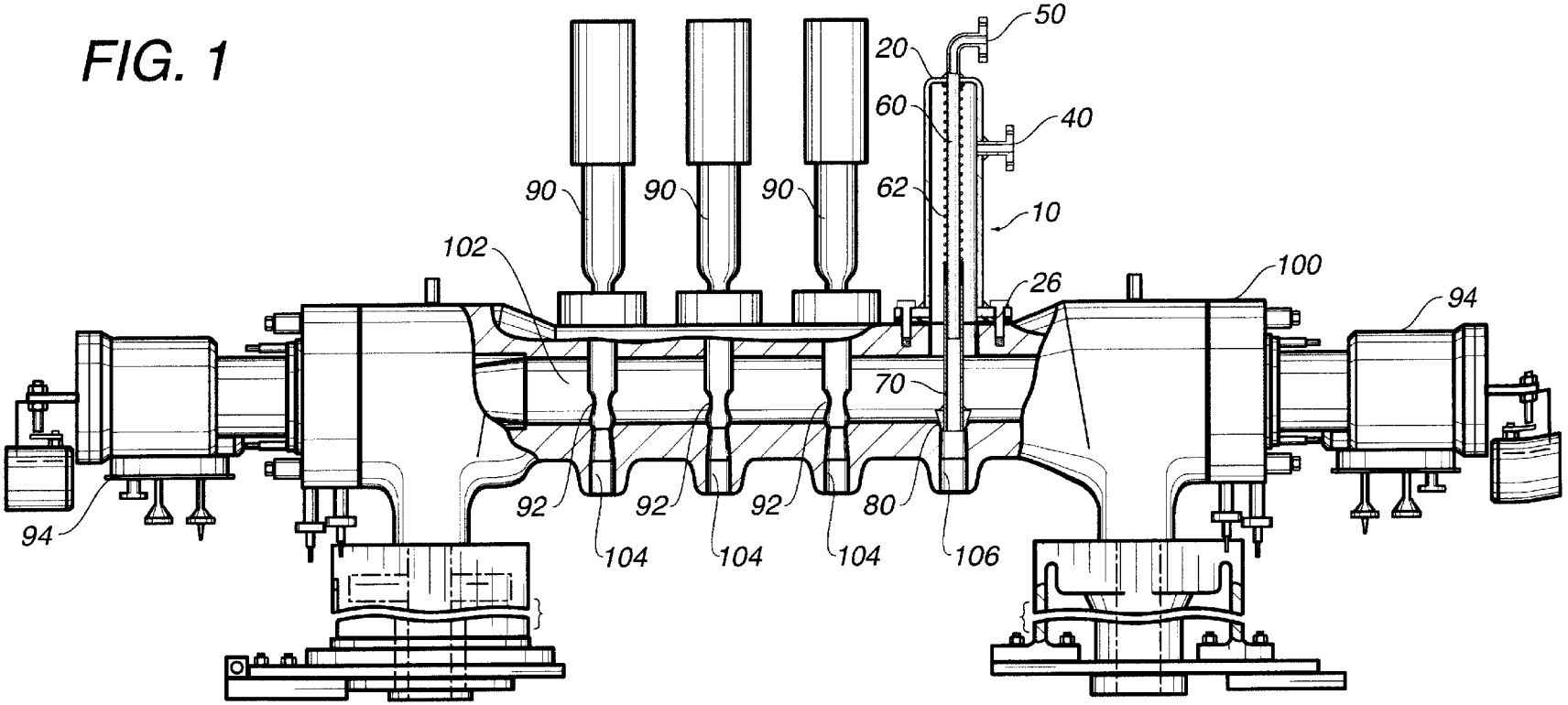
FIG. 1 is a partial cross-section of a turbine steam chest with an injection apparatus in accord with the present invention replacing a governor valve.
Figure 2:
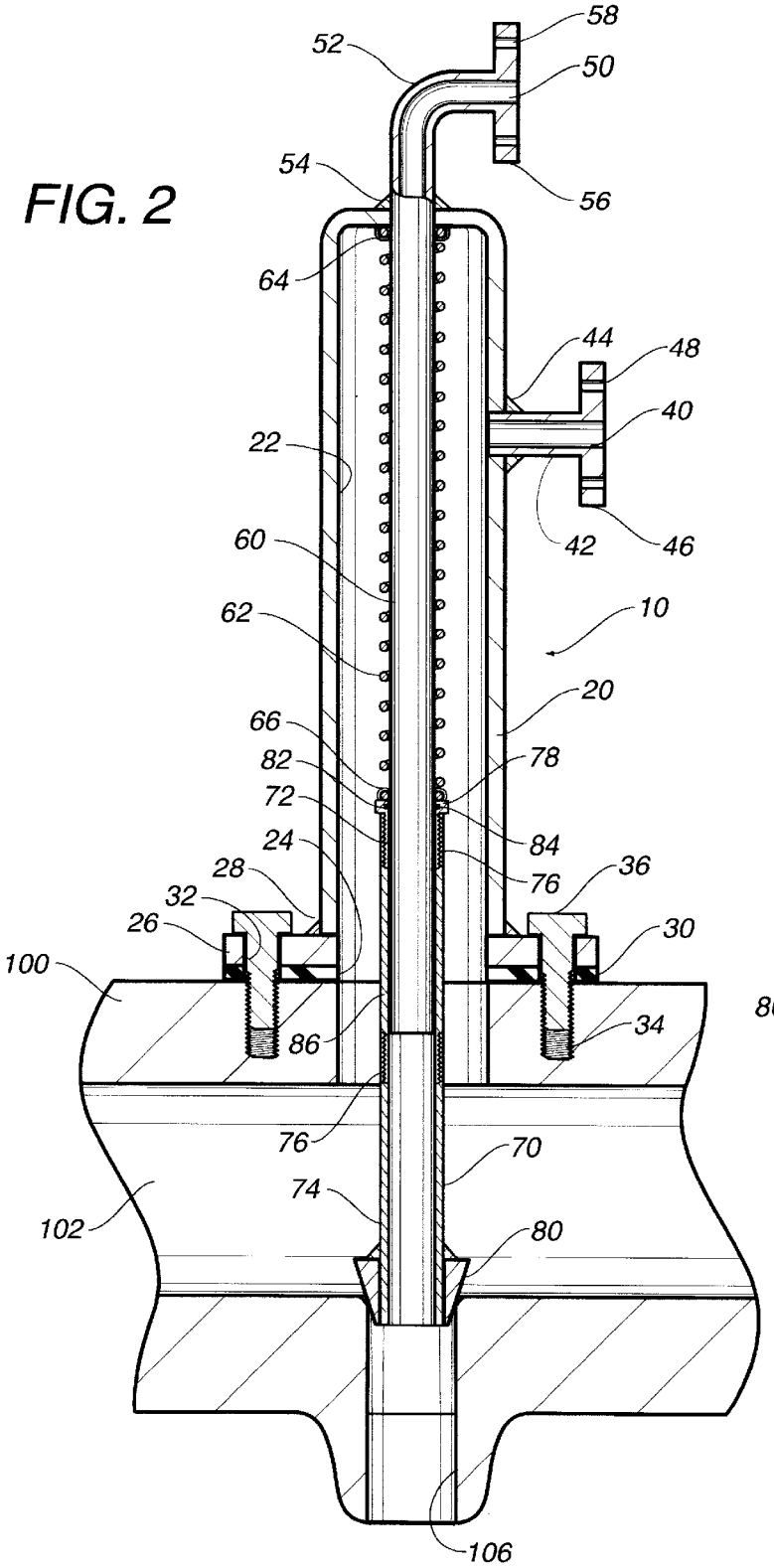
FIG. 2 is a cross-section of an injection apparatus in accord with the present invention including a telescoping injector.
Figure 4:
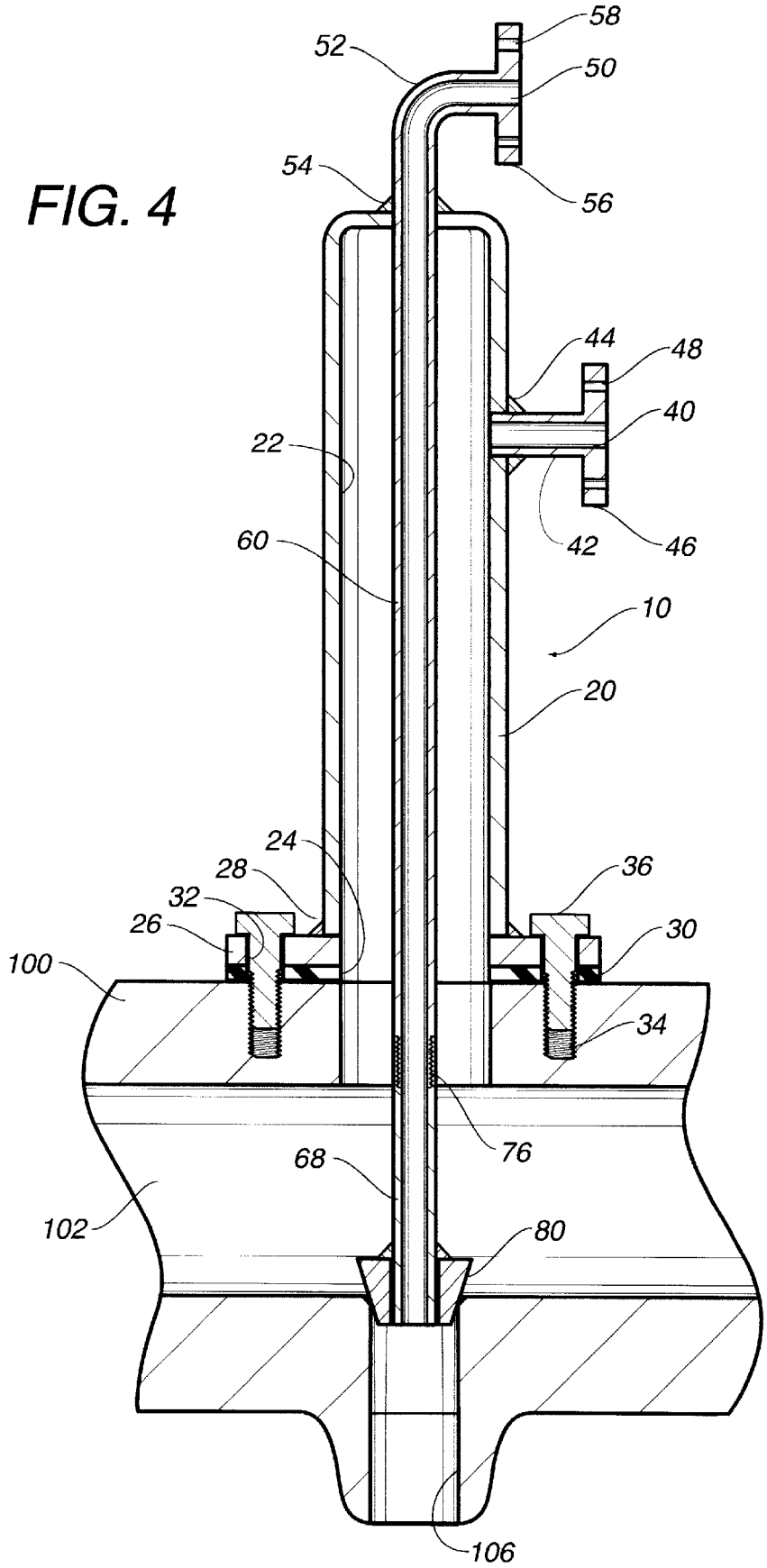
FIG. 4 is a cross-section of an alternative injection apparatus in accord with the present invention including a two-part, fixed length injector.
Figure 5:
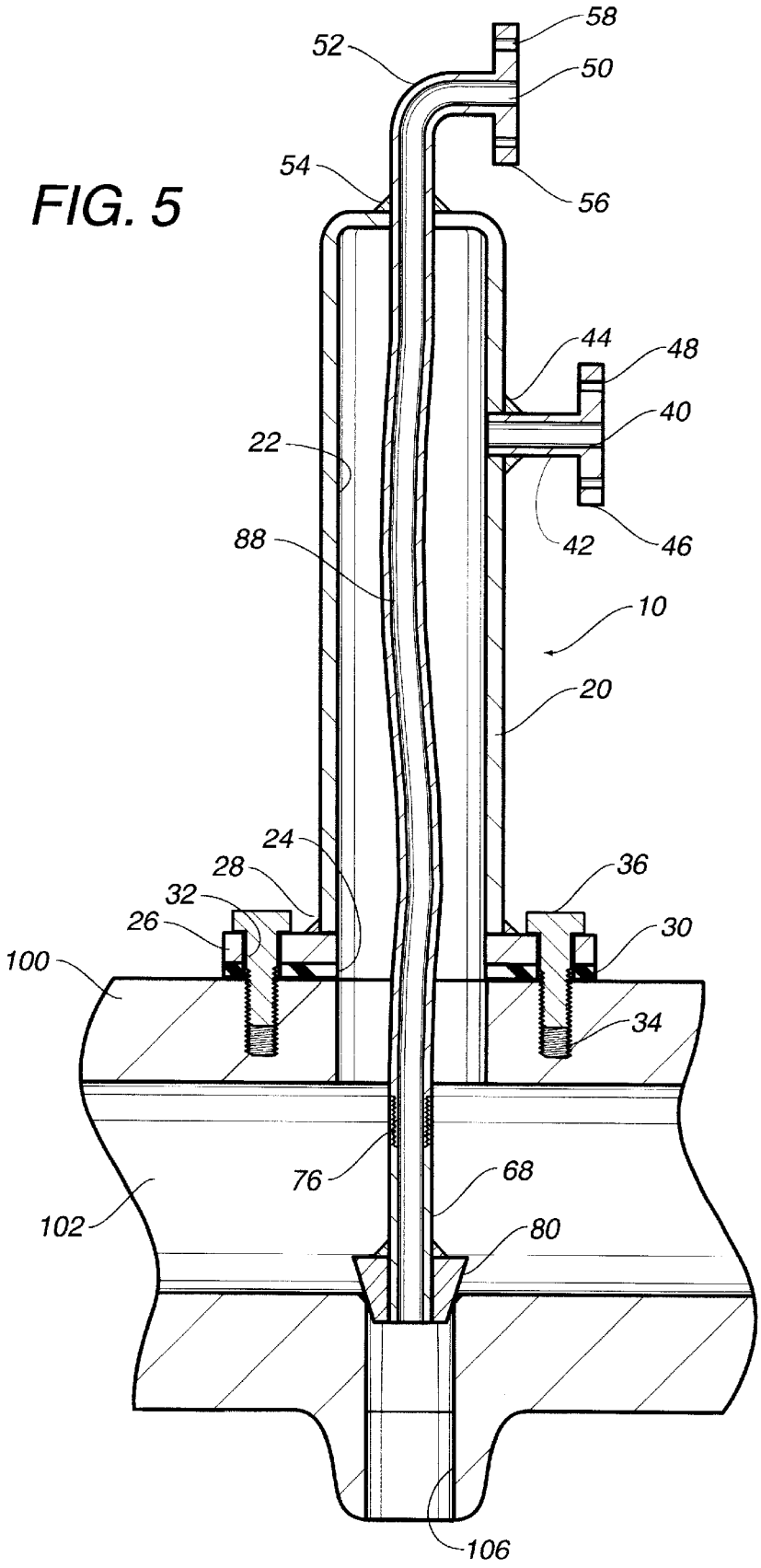
FIG. 5 is a cross-section of another alternative injection apparatus in accord with the present invention including a flexible injector.
Figure 6:
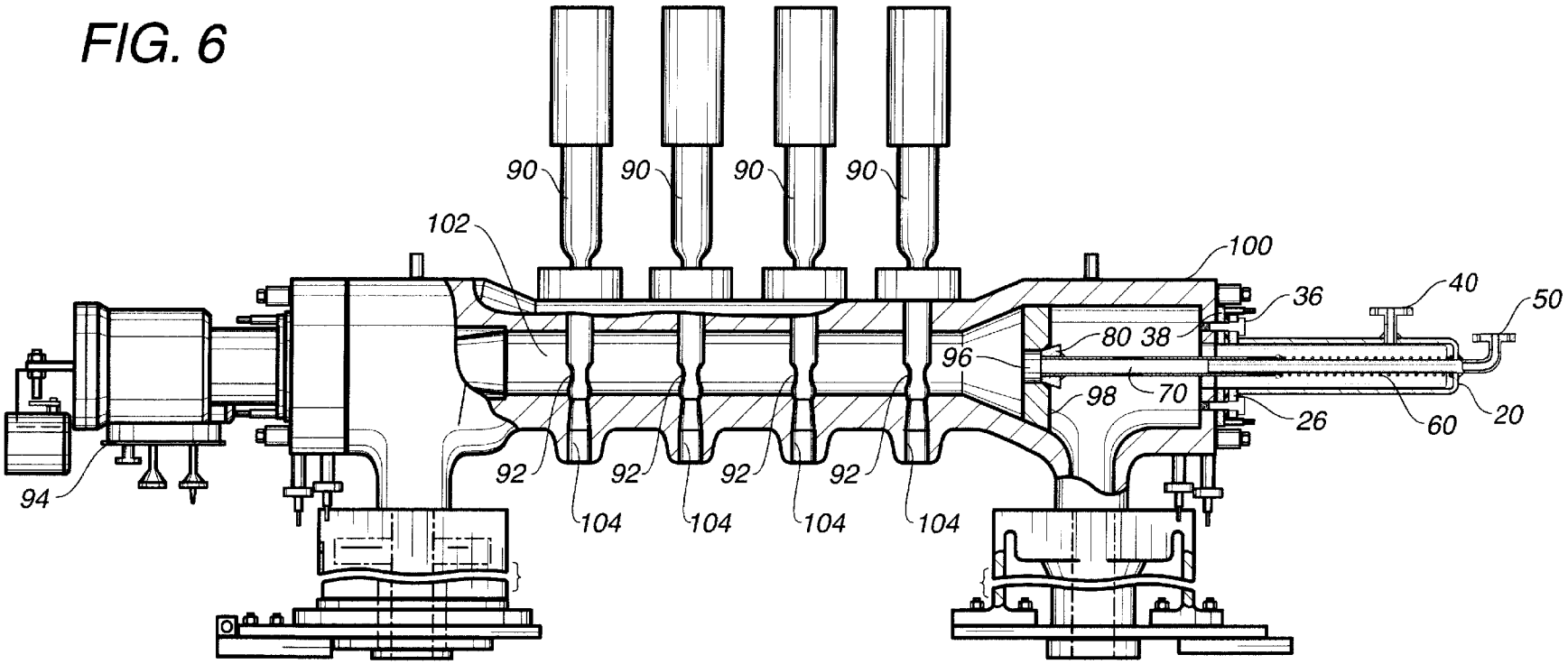
FIG. 6 is a partial cross-section of a turbine steam chest with an injection apparatus in accord with the present invention replacing a throttle valve.

The present invention is directed to an apparatus for injecting cleaning materials, e.g., foamed chemicals, into the steam chest of a turbine and to methods for cleaning high pressure turbines using that apparatus. The presently preferred embodiment of that apparatus is illustrated in FIG. 2. FIGS. 4 and 5 illustrate alternative embodiments. FIGS. 1 and 6 illustrate that apparatus installed on the steam chest of a high pressure turbine.

FIGS. 1 and 6 illustrate a turbine cleaning assembly in accord with the present invention installed in place of a conventional governor valve 90 or throttle valve 94, respectively, on the steam chest 100 of a typical Westinghouse turbine. The term governor valve has historically been used by Westinghouse to describe the valves 90 mounted on the steam chest 100 which control the flow of steam from the steam chest through a plurality of steam chest apertures 104, 106 to the blading. On the other hand, the term throttle valve has historically been used by Westinghouse to describe a valve 94 mounted on the steam chest 100 for controlling the flow of steam into the steam chest.

Valves serving similar functions may be known by other names. For example, General Electric has used the term control valve to describe the valves on General Electric turbines performing the function of the governor valve on the Westinghouse turbine. Similarly, General Electric has used the term stop valve in connection with valves serving the function of the throttle valve on the Westinghouse turbines. Other manufacturers may use either the Westinghouse or General Electric terminology, or may employ still other terms. In the following detailed description and claims, the term governor valve shall include control valve and any other valve serving the same function as the governor valve 90 illustrated in FIGS. 1 and 6. Similarly, the term throttle valve shall include stop valve and any other valve serving the same function as the throttle valve 94 illustrate in FIGS. 1 and 6.

Referring to FIG. 1, a turbine cleaning assembly 10 in accord with the present invention is illustrated attached to a turbine steam chest 100 of an exemplary Westinghouse turbine. The turbine cleaning assembly 10 temporarily replaces a conventional governor valve 90. The turbine cleaning assembly 10 is designed and sized so that it may be interchanged with an existing governor valve 90 without any modification to the steam chest. The cleaning assembly 10 of the present invention has been configured to fit into the space vacated by a removed governor valve 90 so that chemical foam or warmed steam may be injected into the steam chest through the cleaning assembly. While FIG. 1 illustrates the turbine cleaning assembly 10 attached in place of the most forward governor valve, it should be understood that assembly 10 could replace any of the governor valves on the steam chest.

In fact, referring to FIG. 6, a turbine cleaning assembly 10 is illustrated replacing a conventional throttle valve 94 disposed on the end of the steam chest 100 of an exemplary Westinghouse turbine. Because the space available in this location is generally less restrictive than the space occupied by the governor valves, the same cleaning assembly 10 can almost always be employed. However, because the connections may not be identical, it may be necessary to mount the cleaning assembly 10 on an adaptor plate 38 which, in turn, is attached to the steam chest 100 using the connections made available by removal of throttle valve 94. Thus, in this configuration, chemical foam or warming steam may be injected into the steam chest through cleaning assembly 10 without requiring any modification of the main steam loop.

The cleaning assembly 10 of the present invention will be more fully described with reference to FIG. 2 which illustrates the presently most preferred embodiment. Referring to FIG. 2, the turbine cleaning assembly 10 includes a cylindrical housing assembly 20 defining a hollow interior 22 and having an open lower end at housing outlet 24. The assembly includes a mounting flange 26 extending radially outwardly from the lower end of the housing 20 for attachment to the steam chest 100. The mounting flange 26 welded at 28 to the lower end of housing 20 includes a plurality of bolt holes 32 positioned to coincide with threaded bores 34 disposed in the steam chest 100 for mounting conventional governor valves 90. When the cleaning assembly 10 is attached to the steam chest, a flat gasket 30 made of conventional material, e.g., rubber or silicon, is employed between the flange 26 and steam chest 100 to provide an appropriate seal. The flange 26 typically includes four bolt holes for receiving ⅝" bolts 36 used for attaching the conventional governor valve 90 to the steam chest.

The cleaning assembly 10 includes a first inlet 40, typically through a side wall of the cylindrical housing assembly 20 for defining an open passageway for delivering cleaning materials into the hollow interior 22 of the cleaning assembly. In the illustrated embodiment, the first inlet 40 is provided by an inlet tube 42 welded at 44 through a hole in the wall of housing 20 for connection of the inlet to a hose or other line for delivering foamed chemicals or warmed steam to the assembly. In the illustration, extending radially outwardly about the end of tube 42 is a flange 46, including a plurality of small, bolt holes 48 to make the required connection.

The cleaning assembly 10 further includes a second inlet 50 through a wall of the housing assembly 20 for connection with an injector for delivering cleaning materials directly into a turbine blading section. In the illustrated embodiment, the second inlet 50 is provided by inlet tube 52 welded at 54 about an opening in the end of the housing assembly for connection of the inlet to a hose or other line for delivering foamed chemicals or warmed steam to the assembly. Again, extending radially outwardly about the opposite end of tube 52 is flange 56 with a plurality of small, bolt holes 58 to make the required connection. While flanges 46 and 56 have been illustrated with a plurality of small, bolt holes for use with conventional bolts, other connection means may be employed. In fact, those skilled in the art are aware of many such means, including clamps, bolts, screws and the like.

The cleaning assembly 10 further comprises an injector in fluid communication with inlet 50 for delivering cleaning materials through the injector and directly into a turbine blading section. In the presently preferred embodiment illustrated in FIG. 2, the injector comprises a first, fixed tubular member 60 extending from inlet 50 downwardly through the hollow interior 22 of housing assembly 20. In telescoping relation with fixed, tubular member 60 is a second, movable tubular member 70 adapted at one end 80 for engagement with steam chest aperture 106 leading directly into a turbine blading section. In this embodiment, a compression spring 62 disposed around fixed member 60, between the closed end of housing 20 and flange 78 on one end of movable member 70, biases telescoping member 70 into sealing engagement with aperture 106. In the presently preferred embodiment, compression spring 62 is detachably fixed by a mounting clip 64 to housing 20 and by a mounting clip 66 to flange 78 extending radially outwardly about the upward end of telescoping member 70. This attachment facilitates transportation and installation by keeping the injector assembled during these operations.

The depth of steam chest cavity 102 and the diameter and taper of opening 106 into the turbine blading section may vary significantly between manufacturers, designs, models and sizes of turbines. Accordingly, a single telescoping member 70 may not be able to provide the required length or the desired diameter and taper to form a sealing engagement with the aperture of all steam chests. Accordingly, in a further refinement of the present invention, telescoping member 70 may be comprised of a plurality of sections for use with a universal cleaning assembly 10.

Figure 3:
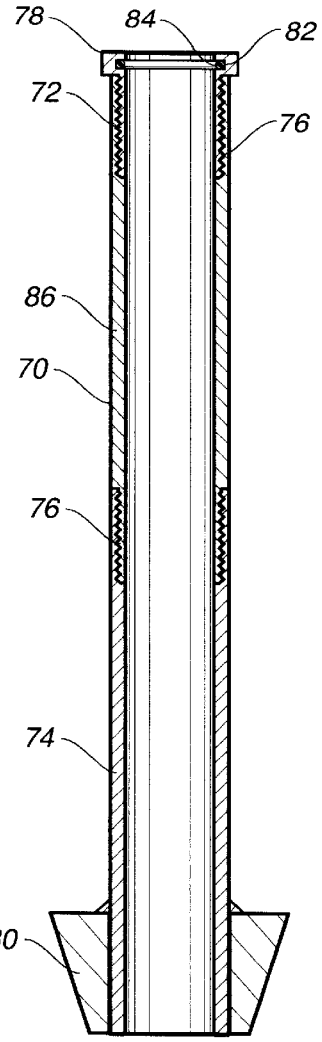
FIG. 3 is a cross-section of the telescoping member of the injection apparatus of the present invention illustrated in FIG. 2.

FIG. 3 illustrates a telescoping member 70 comprised of a plurality of sections. Upper section 72 includes flange 78 for engaging the compression spring 62. Illustrated in this detail drawing is o-ring seal 84 disposed within grove 82 for providing sealing engagement between the telescoping members 60 and 70. Upper section 72 is threaded 76 for detachable engagement directly with a lower section 74 or through an extender or middle section 86. By providing a plurality of lower sections 74, representing a variety of lengths, diameters and tapers for use with upper section 72 and fixed member 60, the injector of assembly 10 can be adapted for use with any steam chest. Further, where necessary, an extender 86 threaded 76 at both ends can provide additional adjustability for length.

FIG. 4 illustrates an alternative embodiment of the present invention wherein the injector is comprised of a first, fixed tubular member 60 detachably affixed at its lower end to a second, tubular member 68 adapted for sealing engagement with steam chest aperture 106. In this embodiment, a plurality of lower members 68 representing a variety of lengths, diameters and tapers are provided, so that selection of the proper tubular member 68 will produce sealing engagement for a wide variety of steam chests. From this selection, a tubular member 68 having the required length, diameter and taper is selected and detachably affixed to the end of fixed member 60. While illustrated as a threaded connection, those skilled in the art will be aware of other means for making an appropriate connection, e.g., a bayonet mount or clamp could be used. In a further alternative embodiment, the second, fixed tubular member 68 is a flexible member, e.g., corrugated, flexible or coil tubing of a length longer than the distance between the lower end of fixed tubular member 60 and the adjacent steam chest aperture 106 to ensure sealing engagement over a small range of distances.

A still further alternative embodiment of the present invention is illustrated in FIG. 5 where the injector merely comprises a flexible tubular member 88, e.g., corrugated, flexible or coil tubing, for providing fluid communication between inlet 50 and steam chest aperture 106. Flexible tubular member 88 may be either permanently or detachably fixed within housing 22 in fluid communication with inlet 50.

Turning now to the methods of the present invention, FIG. 1 illustrates a cleaning assembly 10 of the present invention mounted on the steam chest 100 of an exemplary Westinghouse turbine in place of a conventional governor valve 90. Foamed cleaning materials may be injected through inlet 50 of the cleaning assembly 10 directly into a turbine blading section through adjacent steam chest aperture 106. By operation of the remaining governor valves 90 to selectively open and close valves 92, the remaining steam chest apertures 104 may be opened or closed. Thus, foamed cleaning materials injected through inlet 40 of the cleaning assembly 10 into steam chest cavity 102 may be directed through steam chest apertures 104, in any combination, and into the adjacent turbine blading sections.

FIG. 6 illustrates an alternative placement of cleaning assembly 10. In this alternative configuration, cleaning assembly 10 replaces a conventional throttle valve assembly 94. A cleaning assembly 10 having a mounting flange 26 specifically designed for attachment in place of throttle valve 94 might be employed. However, those skilled in the art will see that the cleaning assembly 10 designed for replacement of a governor valve 90 can readily be employed when coupled with a simple, adaptor plate 38. The adaptor place 38 is configured with bolt holes and a gasket to mount to the steam chest in place of throttle valve 94 and also to receive turbine cleaning assembly 10 using mounting flange 26 adapted for replacement of a conventional governor valve. In this configuration, the injector comprised of telescoping members 60, 70 terminating with taper 80 is designed to sealingly engage steam chest aperture 96 in wall 98. In this configuration, all of the governor valves 90 can be adjusted independently to open any one or more of steam chest apertures 104 into the turbine blading sections.

Those skilled in the art will be able to prepare any desired cleaning material for injection using cleaning assembly 10. For example, a conventional cleaning medium may be prepared from a dry chemical mixed with water and stored in bulk prior to use. Before injecting the chemical into the turbine system, the chemical may be pumped from a bulk supply to a heat exchanger where the temperature may be raised to about 150–170° F. Outside the turbine, air and a foaming agent are added to the chemical to produce a foamed solvent. The air may be added from a 100 psi source regulated by a conventional valve. Referring to FIG. 1, chemical foam is injected into steam chest cavity 102 through inlet 40 or directly into the adjacent turbine blading section through inlet 50. Injection is typically at a rate of about 18 gpm (gallons per minute). The chemical foam is typically at a pressure of about 3–5 psig at the injection point. The foam may be pressurized by a chemical pump which adds flow energy to the chemical before it is turned into foam.

During the chemical cleaning process, flow through one or more steam chest apertures 104, 106 to the turbine blading is required. The chemical foam is free to flow through the cleaning apparatus 10 following the same flow path the steam normally takes through the governor valve outlets. By adjusting the governor valves, flow may be directed through any chosen aperture 104 either individually or in combination with any other aperture 104. This method will ensure proper chemical contact in the steam passages to the blading. The same method is used for pre-warming the turbine with steam.

The methods of the present invention further include returning the spent foamed cleaning materials to a liquid by use of an anti-foaming agent and removing the resulting liquid from the turbine. The resulting liquid is recovered for chemical treatment and proper disposal. Finally, the cleaning assembly 10 is removed, the removed governor valve 90 or throttle valve 94 installed and the turbine returned to service.

The foregoing description has been directed in primary part to a particular preferred embodiment in accord with the requirements of the Patent Statute and for purposes of explanation and illustration. It will be apparent, however, to those skilled in the art that many modifications and changes in the specifically described apparatus and methods may be made without departing from the true scope and spirit of the invention. While the injector of the most preferred embodiment includes telescoping members for providing a universal injector, those skilled in the art know that the same result could be achieved by other means. For example, in an alternative embodiment, the movable telescoping member is replaced with a second, fixed member selected from a series of such members having a variety of lengths, diameters and tapers to produce an injector to fit any desired turbine. Still further, this same objective can be achieved by replacing the telescoping members with a single, flexible tubular member. Those skilled in the art will be able to envision till further combinations of those and other features to produce an injector with no moving parts. Therefore, the invention is not restricted to the preferred embodiment described and illustrated but covers all modifications which may fall within the scope of the following claims.

What is claimed is:

1. An apparatus for injecting cleaning materials into the steam chest of a turbine, said apparatus comprising:

a housing assembly having walls defining a closed, hollow interior terminating with an outlet at one end;

means for attaching said assembly to a turbine so that said outlet is aligned with a turbine port in fluid communication with the steam chest of said turbine;

a first inlet through said walls for defining an open passageway for delivering cleaning material into said hollow interior and through said outlet into said steam chest;

an injector comprising first and second telescoping members, said first telescoping member fixed within said hollow interior, said second telescoping member movable in relation to said fixed member and adapted at one end for sealing engagement with a steam chest aperture adjacent said outlet;

means for biasing said second telescoping member into sealing engagement with said aperture; and a second inlet through said walls in fluid communication with said telescoping injector for delivering cleaning materials through said injector and said turbine aperture to said turbine.

2. The injection apparatus of claim 1 wherein said means for attaching comprises a flange extending outwardly from said outlet.

3. The injection apparatus of claim 2 wherein said flange is adapted to be attached to said turbine in place of a conventional governor valve.

4. The injection apparatus of claim 1 wherein said second telescoping member comprises first and second sections detachably fixed together.

5. The injection apparatus of claim 4 wherein said first section terminates at one end in a flange for contacting said biasing means and said second section terminates at one end with a hollow plug for sealing engagement with said aperture.

6. The injection apparatus of claim 4 wherein said sections are detachably threaded together.

7. The injection apparatus of claim 4 further comprising an extender detachably disposed between said first and second sections.

8. The injection apparatus of claim 4 wherein said first telescoping section is detachably fixed to said biasing means.

9. The injection apparatus of claim 8 wherein said biasing means is detachably affixed to the interior of said housing.

10. An apparatus for injecting cleaning materials into the steam chest of a turbine, said apparatus comprising:

a housing assembly having walls defining a closed, hollow interior terminating with an outlet at one end;

means for attaching said assembly to a turbine so that said outlet is aligned with a turbine port in fluid communication with the steam chest of said turbine;

a first inlet through said walls for defining an open passageway for delivering cleaning material into said hollow interior and through said outlet into said steam chest; and a second inlet through said walls in fluid communication with an injector disposed within said hollow interior and passing through said outlet, said injector adapted for sealing engagement with a steam chest aperture adjacent said outlet for separately delivering cleaning materials to said turbine.

11. The injection apparatus of claim 10 wherein said means for attaching comprises a flange extending outwardly from said outlet.

12. The injection apparatus of claim 11 wherein said flange is adapted to be attached to said turbine in place of a conventional governor valve.

13. The injection apparatus of claim 10 wherein said injector comprises first and second telescoping members.

14. The injection apparatus of claim 13 wherein said first telescoping member is fixed within said hollow interior and said second telescoping member is movable in relation to said fixed member and adapted at one end for sealing engagement with a steam chest aperture adjacent said outlet.

15. The injection apparatus of claim 14, further comprising means for biasing said second tubular member into sealing engagement with said aperture.

16. The injection apparatus of claim 14 wherein said second telescoping member comprises first and second sections detachably fixed together.

17. The injection apparatus of claim 16 wherein said first section terminates at one end in a flange for contacting said biasing means and said second section terminates at one end with a hollow plug for sealing engagement with said aperture.

18. The injection apparatus of claim 16 wherein said sections are detachably threaded together.

19. The injection apparatus of claim 16 further comprising an extender detachably disposed between said first and second sections.

20. The injection apparatus of claim 10 wherein said injector comprises first and second members, said first member being fixed within said hollow interior and said second member being detachably fixed to said first member and adapted for sealing engagement with said aperture.

21. The injection apparatus of claim 20 wherein said first and second members are detachably threaded together.

22. The injection apparatus of claim 20 wherein said second member is a flexible tubular member.

23. The injection apparatus of claim 10 wherein said injector is a flexible tubular member adapted at one end for sealing engagement with said aperture.

24. A method for cleaning a turbine with cleaning materials injected through the steam chest of said turbine, said steam chest including a plurality of valves comprising at least one stop/throttle valve and a plurality of control/governor valves each of which separately controls one of a plurality of steam apertures leading to the interior of said turbine, said method comprising:

removing one of said plurality of valves;

attaching to said steam chest in place of said removed valve an apparatus for injecting cleaning materials into said steam chest, said apparatus capable of injecting said cleaning materials into the interior of said turbine through one or more of said steam apertures selectable by operation of the remaining control/governor valves without requiring movement of any part of said injection apparatus;

pumping foamed cleaning materials into said steam chest through said apparatus and allowing said foamed cleaning materials to enter said turbine through one or more of said steam apertures while said turbine is turning for providing better foam contact;

returning the spent foamed cleaning materials to a liquid by use of an anti-foaming agent;

removing the resulting liquid for chemical treatment and proper disposal; and replacing said injection apparatus with said removed valve.

25. The method of claim 24 wherein said removed valve is a control/governor valve.

26. The method of claim 24 wherein said removed valve is a stop/throttle valve.

27. The method of claim 24 further comprising prewarming the turbine with steam to enhance the chemical cleaning reaction of said foamed cleaning materials.

28. The method of claim 24 wherein said apparatus for injecting cleaning materials is the apparatus of claim 10.

29. The method of claim 24 wherein said apparatus for injecting cleaning materials is the apparatus of claim 1.

* * * * *